US007775208B2

(12) United States Patent
Carepa et al.

(10) Patent No.: US 7,775,208 B2
(45) Date of Patent: Aug. 17, 2010

(54) DEVICE FOR SUPPLYING BREATHING GAS, PARTICULARLY FOR MOUTHPIECE OF A DIVER

(75) Inventors: Stephane Carepa, Carros (FR); Thomas Maeckelberghe, Carros (FR); Nicolas Peyron, Carros (FR)

(73) Assignee: La Spirotechnique, Carros (FR)

( * ) Notice: Subject to any disclaimer, the term of this patent is extended or adjusted under 35 U.S.C. 154(b) by 584 days.

(21) Appl. No.: 11/776,742

(22) Filed: Jul. 12, 2007

(65) Prior Publication Data

US 2008/0017200 A1 Jan. 24, 2008

(30) Foreign Application Priority Data

Jul. 13, 2006 (FR) ..... 06 52971

(51) Int. Cl.
*A61M 11/00* (2006.01)

(52) U.S. Cl. ..... 128/205.24; 128/204.18

(58) Field of Classification Search ..... 128/204.18, 128/201.27, 201.28, 204.26, 205.24
See application file for complete search history.

(56) References Cited

U.S. PATENT DOCUMENTS

| | | | | |
|---|---|---|---|---|
| 4,147,176 A | | 4/1979 | Christianson et al. | |
| 5,222,490 A | | 6/1993 | Pomerantz et al. | |
| 5,343,858 A | * | 9/1994 | Winefordner et al. | 128/204.26 |
| 5,690,100 A | * | 11/1997 | Pomerantz | 128/205.24 |
| 6,718,976 B1 | * | 4/2004 | Matsuoka | 128/204.26 |
| 6,848,445 B2 | * | 2/2005 | Garofalo | 128/204.26 |
| 2002/0020415 A1 | * | 2/2002 | Pietrelli | 128/205.24 |
| 2002/0157669 A1 | * | 10/2002 | Chen | 128/201.28 |

FOREIGN PATENT DOCUMENTS

EP 0649783 4/1995

OTHER PUBLICATIONS

European Search Report dated Apr. 5, 2007 from EP0652971.

* cited by examiner

*Primary Examiner*—Steven O Douglas
(74) *Attorney, Agent, or Firm*—Young & Thompson

(57) ABSTRACT

Device for supplying breathing gas, particularly for a mouthpiece of a diver, including a casing incorporating, between an inlet orifice for the supply gas and an orifice or the outlet of the gas for the purpose of breathing: a pressure-reducing valve system having a member for controlling the force necessary to open the valve, a member for controlling the flow rate of the gas let into the outlet orifice, the supply device also including a manually actuatable control element capable of interacting with the control member in order to adjust the force necessary to open the valve, characterized in that the control element is capable of interacting also with the member for controlling the flow rate of gas in order to ensure both the adjustment of the force for opening the valve and the adjustment of the flow rate of outlet gas.

20 Claims, 2 Drawing Sheets

DEVICE FOR SUPPLYING BREATHING GAS, PARTICULARLY FOR MOUTHPIECE OF A DIVER

Figure 1:
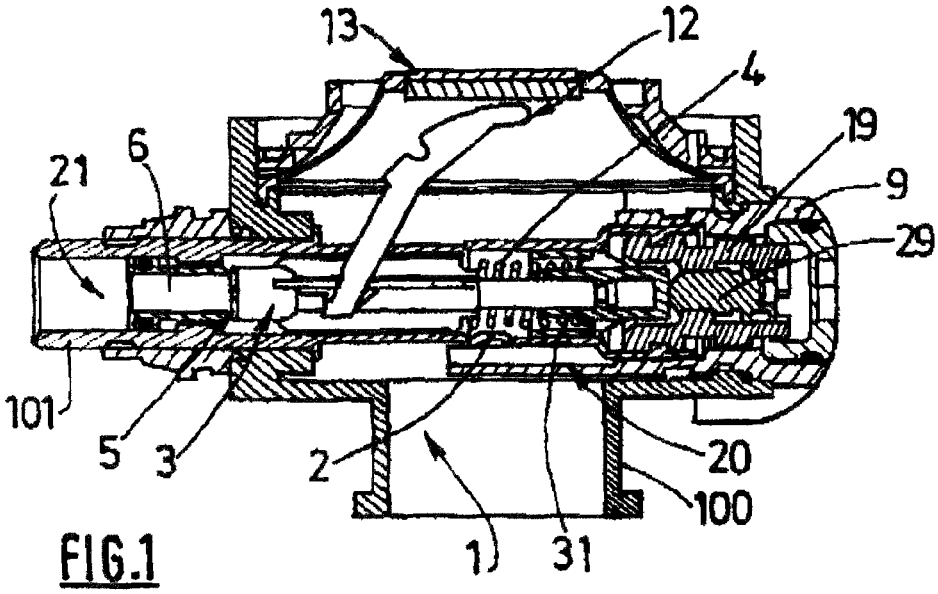

The present invention relates to a device for supplying breathing gas, particularly for a mouthpiece of a driver.

The invention relates in particular to the field of on-demand valves for breathable gas supply systems for divers.

The invention relates more particularly to a device for supplying breathing gas comprising a casing incorporating, between an inlet orifice for the supply gas and an orifice for the outlet of the gas for the purpose of breathing:

a pressure-reducing valve system comprising a member for controlling the force necessary to open the said valve, a member for controlling the flow rate of gas let into the outlet orifice, the supply device also comprising a manually actuatable control element capable of interacting with the control member in order to adjust the force necessary to open the valve.

Pressure-reducing valves for pressurized breathable gases intended for sea diving comprise a device commonly called an "on-demand valve" that delivers to the diver a quantity of breathable gas when a breath is taken. Certain on-demand valves comprise manual adjustments making it possible to adapt their operation to the breathing comfort of the diver.

Known devices comprise a mechanism for adjusting the opening force necessary to open the pressure-reducing valve allowing gas to be delivered to the user. This type of mechanism makes it possible to modify the necessary negative pressure that the user must exert (aspiration) so that the valve opens and delivers the gas. Usually, a first adjustment button is provided to modify the preload of a return means acting on the pressure-reducing valve.

Known devices comprise a second button for adjusting the flow rate of breathable gas delivered to the mouthpiece when breathing in (also called adjustment of the Venturi effect). This flow rate adjustment is obtained conventionally by diverting the gas jet before it comes out to the mouthpiece.

The known solutions therefore offer relatively satisfactory systems for adjusting the force for opening the valve and the flow rate of gas delivered. However, in practice, the adjustments of these two parameters are not very practical and not very ergonomic. Accordingly, it is usually difficult for a user to make an adjustment of these two parameters rapidly.

One aim of the present invention is to remedy some or all of the disadvantages of the prior art listed above.

For this purpose, the device for supplying breathing gas according to the invention, also conforming to the generic definition that the above preamble gives thereto, is essentially characterized in that the said control element is capable of interacting also with the member for controlling the gas flow rate in order to ensure both the adjustment of the force for opening the valve and the adjustment of the flow rate of outlet gas.

Furthermore, embodiments of the invention may include one or more of the following features:

the control element is formed in order to interact simultaneously with the member for controlling the opening force and with the member for controlling the flow rate, in order to simultaneously couple an increase of the gas flow rate with a reduction in the force necessary to open the valve when the control element is actuated in a first direction, the control element is formed in order to interact simultaneously with the member for controlling the opening force and with the member for controlling the flow rate, in order to simultaneously couple a reduction of the gas flow rate with an increase in the force necessary to open the valve when the control element is actuated in a second direction, the member for controlling the force necessary to open the valve comprises a return element such as a compression spring directly or indirectly pushing the valve to a position of closure of the gas passageway relative to a seat, the control element being capable of interacting mechanically directly or indirectly with the return element in order to modify its preload, and particularly its degree of compression, the member for controlling the force necessary to open the valve comprises a compression spring whose first end is pressing on the valve or a valve-holder and whose second end is pressing on a movable support, the movable support being held in a determined position relative to the valve seat by means of a movable stop, the control element being coupled mechanically to the said stop, in order to ensure, depending on the direction of actuation of the control element, the translation of the said movable stop in the direction of moving closer to or further away from the second end of the spring relative to the valve seat, the pressure-reducing valve system comprises a pressure-compensating valve allowing gas to pass through the valve from the inlet orifice to a sealed compensation chamber situated downstream of the valve seat, the movable support delimits at least a portion of the compensation chamber, the member for controlling and adjusting the flow rate of gas let into the outlet orifice comprises at least one through-orifice and a movable cover capable of interacting or not with the through-orifice in order to modify the passageway section of the latter by blanking off, the control element is mounted so as to be able to rotate relative to the casing and the cover is fixedly attached in rotation to the control element, the control element is mounted so as to be able to rotate relative to the casing and the cover can be moved in translation relative to the orifice, the translation movement of the cover being coupled with the rotary movement of the control element via an angle transmission system of the rack type or with matching screw pitch, the movable cover is formed by at least one portion of the movable support, the member for controlling and adjusting the gas flow rate is situated between the pressure-reducing valve system and the outlet orifice, the pressure-reducing valve system, the member for controlling the force necessary to open the valve, the member for controlling the flow rate of gas let into the outlet orifice and the control element are mounted in and/or on a substantially tubular and rectilinear body housed in the casing, the pressure-reducing valve is mounted on a piston sliding under the action of a stem coupled to a lever pressing on a diaphragm forming a delimitation of the internal volume of the casing, the control element is mounted so as to move in rotation and/or in translation relative to the casing.

Figure 2:
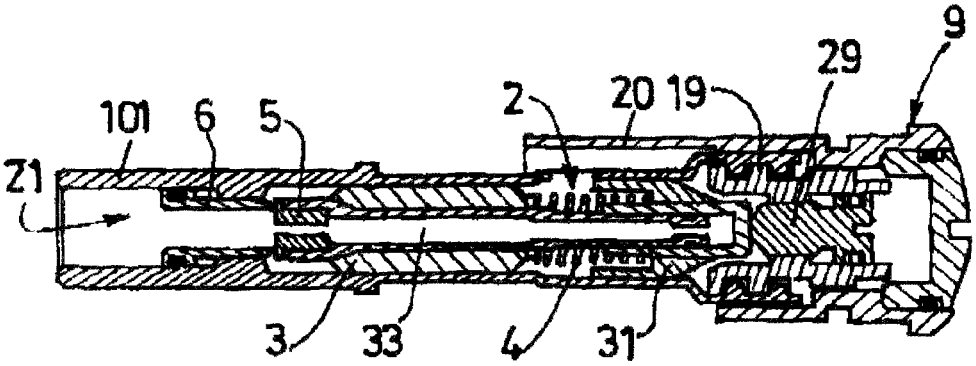
Figure 3:
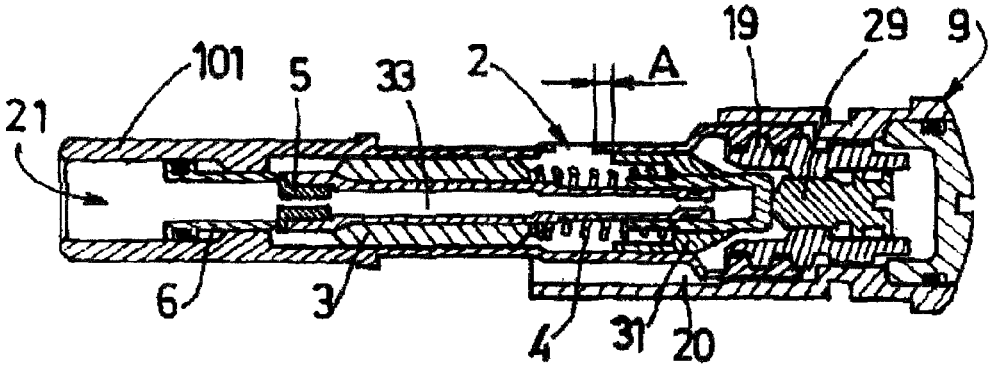
Figure 4:
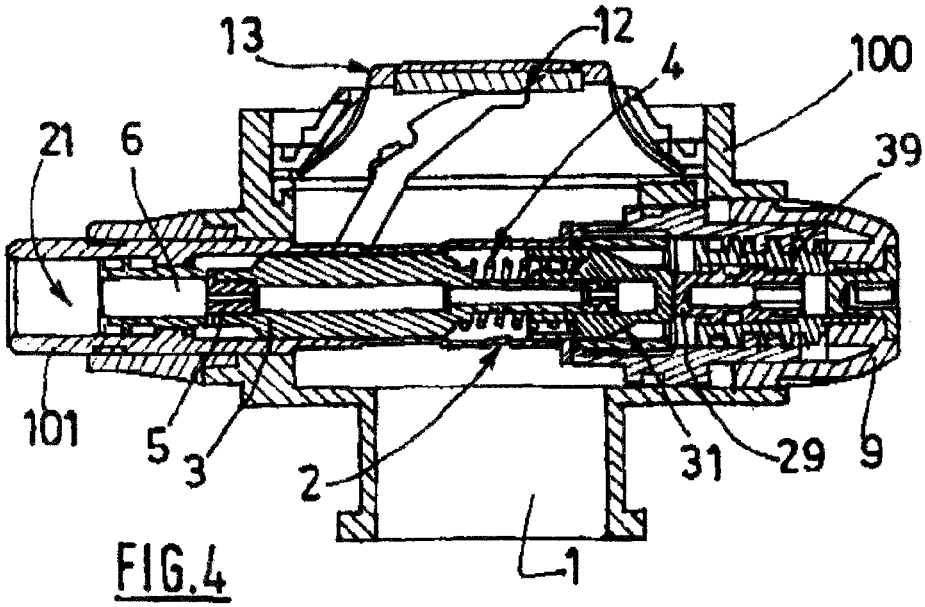
Figure 5:
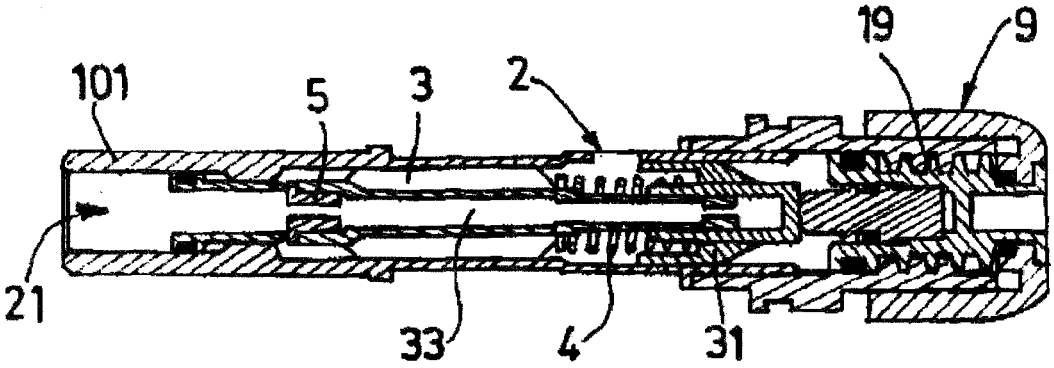
Figure 6:
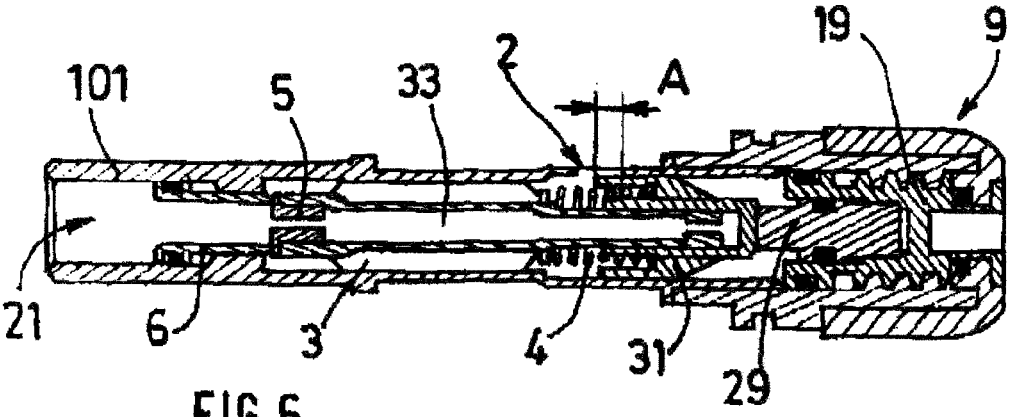

Other particular features and advantages will appear on reading the following description, made with reference to the figures in which:

FIG. 1 represents a simplified view in section of a breathing gas supply device according to a first exemplary embodiment of the invention in a first position of use called "maximum breathing resistance and minimum flow rate", FIG. 2 represents a view of a detail of the device of FIG. 1 along another sectional plane in which only a portion of the device is shown, FIG. 3 represents a view in section of the device similar to that of FIG. 2 in a second position of use called "minimum breathing resistance and maximum flow rate", FIG. 4 represents a view similar to that of FIG. 1 illustrating a breathing gas supply device according to a second exemplary embodiment of the invention in a first position of use called "minimum breathing resistance and maximum flow rate", FIG. 5 represents a view of a detail of the device of FIG. 4 along another sectional plane in which only a portion of the device is shown, FIG. 6 represents a view in section of the device similar to that of FIG. 5 in a second position of use called "maximum breathing resistance and minimum flow rate".

FIG. 1 represents a view in section of an on-demand valve, that is to say a breathable gas supply device according to the invention.

The breathable gas supply device comprises a casing 100 provided with an inlet orifice 21 for the pressurized supply gas (originating for example from a bottle) and an outlet orifice 1 for the gas intended to be connected to the breathing apparatus of the diver (via a mouthpiece for example).

Between the inlet orifice 21 and the outlet orifice 1, the device comprises a pressure-reducing valve system 3, 4, 5, 6 and a member 2, 20 for controlling the flow rate of gas let into the outlet orifice.

As shown in FIG. 1, the pressure-reducing valve system may conventionally comprise a valve 5 mounted on a piston 3 or valve-holder interacting with a seat 6. The piston 3 is fixedly attached to a stem sliding axially in the casing 100. The movement of the stem (and of the valve) is controlled by a lever 12 whose free end presses against a flexible diaphragm 13 and the other end is connected pivotingly to a fixed point of the casing and to the stem of the valve. In a known manner, the diaphragm 13 is subjected on the one hand to the pressure of the breathing gas on the inside of the casing 100 and, on the other hand, to the surrounding pressure (water) on the outside of the casing 100. The breathing gas pressure is regulated according to the outside pressure and the breathing demand of the diver. When the diver breathes in, the diaphragm 13 collapses (breath intake negative pressure) which causes the lever 12 to pivot clockwise and move the piston stem and hence the valve in its opening direction, thus allowing the inlet of breathing gas to the outlet 1. When the diver breathes out, the negative pressure is eliminated and the valve 5 is closed again under the action of a compression spring 4. The air breathed out for its part escapes via an expiration valve not shown.

More precisely, in the exemplary embodiment shown in FIGS. 1 and 2, the pressure-reducing valve system 3, 4, 5 is mounted in a substantially tubular and rectilinear body 101. One end of the body 101 delimits the inlet 21 for the breathing gas. Downstream of the inlet orifice 21, the valve system comprises a ring-shaped valve seat 6, a valve 5 designed to interact with the seat 6. The valve 5 is mounted on the end of a valve-holder 3 or piston (or similar) that is pushed away towards the seat 6 by means of a compression spring 4 or equivalent.

In the non-limiting exemplary embodiment shown, the pressure-reducing valve system is of the pressure compensation valve type. That is to say that the valve 5 comprises a central passageway allowing gas to travel from the inlet 21 to a sealed compensation chamber 33 situated downstream of the seat 6 (FIG. 2). The compensation chamber 33 is delimited by the body of the valve-holder 3 and a movable support 31 for the spring 4 that will be described in greater detail below. In a manner known per se, compensation valves make it possible to balance the forces on the valve and in particular make it possible to render the valve insensitive to the pressure changes that may occur between upstream and downstream of the valve 5. In this manner, the force necessary to open the valve is substantially independent of these pressure variations in this portion of the circuit.

A first end of the spring 4 is pressing on the valve-holder 3 while the second end of the spring 4 is pressing on a circular groove formed in the movable support 31.

The movable support 31 is held in a determined position relative to the seat 6 of the valve 5 by means of a movable stop 29 mechanically coupled to a control element 9 that can be actuated manually and protrudes from the casing 100 at the other end of the tubular body 101.

For example, the control element 9 is a button 9 that rotates about the axis of the body 101. The control button 9 is rotatably connected with an inner movable and threaded ring 19 that interacts with a paired tapping formed on the inner surface of the body 101. The movable stop 29 is, for its part, fixedly attached to the ring 19. Therefore, depending on the direction of rotation of the control button 9, the ring moves closer to (FIGS. 1 and 2) or further away from (FIG. 3) the seat 6 of the valve by a distance lying within a range A. Accordingly, the movable stop 29 increases or reduces the compression of the spring 4. The rotation of the control button 9 therefore allows the user to adjust the preload of the spring 9 of the valve 5, which determines the force necessary to open the valve 5. The force of breath intake necessary to open the valve is therefore increased when the compression of the spring is increased and vice-versa.

For simplification purposes, the casing 100 and the mechanism with lever 12 and diaphragm 13 have not been shown in FIGS. 2, 3, 5 and 6.

The device furthermore comprises a member 2, 20 for controlling the flow rate of gas let into the outlet orifice 1 of the casing 100.

In the example shown, the tubular body 101 comprises at least one orifice 2 situated downstream of the seat 6 of the valve 5 and opening into the internal volume of the casing 100. The internal volume of the casing communicates with the outlet orifice 1. During its journey between the seat 6 of the valve and the orifice 2, the gas travels, for example, along longitudinal passageways (such as grooves) formed between the outer surface of the valve-holder 3 and the inner surface of the tubular body 101 (not shown).

A movable cover 20 comprising a wall substantially concentric with the body 101 is capable of closing off or not closing off at least a portion of the orifice 2 (FIGS. 1 and 2) to modify the flow rate of gas capable of travelling towards the outlet 1. The cover 20 is fixedly attached to the control button 9 and is preferably made in one piece with the latter.

In this manner, the control button 9 is capable of controlling both the adjustment of the force for opening the valve 5 and the adjustment of the outlet 1 gas flow rate. That is to say that the user actuates a single control member to adjust the two breathing comfort parameters.

For example, the control button 9 and the ring mechanism 19 may be conformed to couple simultaneously (actuation in a first direction) a reduction of the gas flow rate (progressive closing of the orifice 2) with an increase in the force necessary to open the valve 5 (gradual compression of the spring 4).

In the same manner, the actuation of the control button 9 in the inverse direction may couple an increase in the gas flow rate (removing the cover relative to the orifice 2) with a reduction in the force necessary to open the valve 5 (gradual decompression of the spring 4).

FIGS. 4 to 6 illustrate a variant embodiment that differs from the embodiment of FIGS. 1 to 3 only in that the control of the flow rate of gas delivered is provided by the movable support 31 itself (instead of the wall fixedly attached to the control button 9). The movable support 31 comprises an outer surface that slides in the tubular body 101. When the movable support moves (actuation of the control button 9), an end of the movable support 31 may or may not come to coincide with at least a portion of the orifice 2 in order to reduce or not reduce its passageway cross section (length A, FIG. 6). For conciseness, the elements that are identical to those described hereinabove are indicated by the same reference numbers and are not described a second time.

Therefore, while being a simple and compact structure, the invention allows a simplified adjustment of the breathing comfort parameters of a device for supplying breathing gas.

Naturally, the invention is not limited to the examples described above. In particular, the pressure compensation valve system may be replaced by a conventional system with a non-compensating valve. Similarly, the control member may be replaced by a button capable of being actuated in translation.

Naturally, the adjustment of the gas flow rate similar to the adjustment of the force for opening the valve may be achieved by any other equivalent means. For example, the control element that controls both the adjustment of the flow rate and the adjustment of the force may be connected to a mechanism using connecting rods and/or cams and/or pinions and/or using plastic or elastic deformation. For example, to adjust the gas flow rate, the control element may be connected by any movement transmission means to a movable cover and passageway orifice system (or any other similar means) positioned in front of the outlet 1 and preferably between the body 101 and the outlet 1.

The invention claimed is:

1. Device for supplying breathing gas, particularly for a mouthpiece of a diver, comprising a casing (100) incorporating, between an inlet orifice (21) for the supply gas and an orifice (1) for the outlet of the gas for the purpose of breathing:

a pressure-reducing system (3, 4, 5) comprising a member (4, 31) for controlling the force necessary to open the said valve, a member (2, 20) for controlling the flow rate of gas let into the outlet orifice (1), the supply device also comprising a manually actuatable control element (9) capable of interacting with the control member (4, 31) in order to adjust the force necessary to open the valve, characterized in that the said control element (9) is capable of interacting also with the member (2, 20) for controlling the flow rate of gas in order to ensure both the adjustment of the force for opening the valve (5) and the adjustment of the flow rate of outlet gas.

2. Device according to claim 1, characterized in that the control element (9) is formed in order to interact simultaneously with the member (4, 31) for controlling the opening force and with the member (2, 20) for controlling the flow rate, in order to simultaneously couple an increase of the gas flow rate with a reduction in the force necessary to open the valve when the control element (9) is actuated in a first direction.

3. Device according to claim 1, characterized in that the control element (9) is formed in order to interact simultaneously with the member (4, 31) for controlling the opening force and with the member (2, 20) for controlling the flow rate, in order to simultaneously couple a reduction of the gas flow rate with an increase in the force necessary to open the valve when the control element (9) is actuated in a section direction.

4. Supply device according to claim 1, characterized in that the member (4, 31) for controlling the force necessary to open the valve comprises a return element (4) such as a compression spring directly or indirectly pushing the valve (5) to a position of closure of the gas passageway relative to a seat (6), the control element (9) being capable of interacting mechanically directly or indirectly with the return element (4) in order to modify its preload, and particularly its degree of compression.

5. Supply device according to claim 1, characterized in that the member (4, 31) for controlling the force necessary to open the valve comprises a compression spring (4) whose first end is pressing on the valve (5) or a valve-holder (3) and whose second end is pressing on a movable support (31), the movable support (31) being held in a determined position relative to the valve seat by means of a movable stop (29), the control element (9) being coupled mechanically to the said stop (29), in order to ensure, depending on the direction of actuation of the control element (9), the translation of the said movable stop in the direction of moving closer to or further away from the second end of the spring (4) relative to the valve seat.

6. Supply device according to claim 1, characterized in that the pressure-reducing valve system (3, 4, 5) comprises a pressure-compensating valve (3, 5) allowing gas to pass through the valve from the inlet orifice (21) to a sealed compensation chamber (33) situated downstream of the valve seat (3).

7. Supply device according to claim 6, characterized in that the movable support (31) delimits at least a portion of the compensation chamber (33).

8. Supply device according to claim 5, characterized in that the member (2, 20) for controlling and adjusting the flow rate of gas let into the outlet orifice (1) comprises at least one through-orifice (2) and a movable cover (20, 31) capable of interacting or not with the through-orifice (2) in order to modify the passageway section of the latter by blanking off.

9. Supply device according to claim 8, characterized in that the control element (9) is mounted so as to be able to rotate relative to the casing and in that the cover (20, 31) is fixedly attached in rotation to the control element (9).

10. Supply device according to claim 8, characterized in that the control element (9) is mounted so as to be able to rotate relative to the casing and in that the cover (31) can be moved in translation relative to the orifice (2), the translation movement of the cover (31) being coupled with the rotary movement of the control element (9) via an angle transmission system of the rack type or with the matching screw pitch.

11. Supply device according to claim 8, characterized in that the movable cover (31) is formed by at least one portion of the movable support (31).

12. Supply device according to claim 1, characterized in that the member (2, 20) for controlling and adjusting the gas flow rate is situated between the pressure-reducing valve system (3, 4, 5) and the outlet orifice (1).

13. Supply device according to claim 1, characterized in that the member (2, 20) for controlling and adjusting the flow rate of gas let into the outlet orifice (1) comprises at least one through-orifice (2) and a movable cover (20, 31) capable of interacting or not with the through-orifice (2) in order to modify the passageway section of the latter by blanking off.

14. Device according to claim 2, characterized in that the control element (9) is formed in order to interact simultaneously with the member (4, 31) for controlling the opening force and with the member (2, 20) for controlling the flow rate, in order to simultaneously couple a reduction of the gas flow rate with an increase in the force necessary to open the valve when the control element (9) is actuated in a section direction.

15. Supply device according to claim 2, characterized in that the member (4, 31) for controlling the force necessary to open the valve comprises a return element (4) such as a compression spring directly or indirectly pushing the valve (5) to a position of closure of the gas passageway relative to a seat (6), the control element (9) being capable of interacting mechanically directly or indirectly with the return element (4) in order to modify its preload, and particularly its degree of compression.

16. Supply device according to claim 3, characterized in that the member (4, 31) for controlling the force necessary to open the valve comprises a return element (4) such as a compression spring directly or indirectly pushing the valve (5) to a position of closure of the gas passageway relative to a seat (6), the control element (9) being capable of interacting mechanically directly or indirectly with the return element (4) in order to modify its preload, and particularly its degree of compression.

17. Supply device according to claim 2, characterized in that the member (4, 31) for controlling the force necessary to open the valve comprises a compression spring (4) whose first end is pressing on the valve (5) or a valve-holder (3) and whose second end is pressing on a movable support (31), the movable support (31) being held in a determined position relative to the valve seat by means of a movable stop (29), the control element (9) being coupled mechanically to the said stop (29), in order to ensure, depending on the direction of actuation of the control element (9), the translation of the said movable stop in the direction of moving closer to or further away from the second end of the spring (4) relative the valve seat.

18. Supply device according to claim 2, characterized in that the pressure-reducing valve system (3, 4, 5) comprises a pressure-compensating valve (3, 5) allowing gas to pass through the valve from the inlet orifice (21) to a sealed compensation chamber (33) situated downstream of the valve seat (3).

19. Supply device according to claim 2, characterized in that the member (2, 20) for controlling and adjusting the flow rate of gas let into the outlet orifice (1) comprises at least one through-orifice (2) and a movable cover (20, 31) capable of interacting or not with the through-orifice (2) in order to modify the passageway section of the latter by blanking off.

20. Supply device according to claim 2, characterized in that the member (2, 20) for controlling and adjusting the gas flow rate is situated between the pressure-reducing valve system (3, 4, 5) and the outlet orifice (1).

* * * * *

UNITED STATES PATENT AND TRADEMARK OFFICE

CERTIFICATE OF CORRECTION

PATENT NO. : 7,775,208 B2
APPLICATION NO. : 11/776742
DATED : August 17, 2010
INVENTOR(S) : Stephane Carepa, Thomas Maeckelberghe and Nicolas Peyron It is certified that error appears in the above-identified patent and that said Letters Patent is hereby corrected as shown below:

In Column 5, line 43, insert the word --valve-- after the word "pressure-reducing".

In Column 5, line 45, delete the word "said".

In Column 5, line 51, delete the word "said".

In Column 6, line 21, delete the word "said".

In Column 6, line 23, delete the word "said".

In Column 8, line 4, delete the word "said".

In Column 8, line 6, delete the word "said".

Signed and Sealed this

Twenty-sixth Day of October, 2010

David J. Kappos

David J. Kappos
*Director of the United States Patent and Trademark Office*